United States Patent [19]

Lee

[11] 4,015,301

[45] Apr. 5, 1977

[54] CUT-OFF STOCK FEEDING DEVICE FOR AN AUTOMATIC HIGH SPEED COLD NUT FORMER

[76] Inventor: Yuan Ho Lee, 85, Jen Ho Road, Tainan, China /Taiwan

[22] Filed: Aug. 19, 1975

[21] Appl. No.: 605,840

[52] U.S. Cl. ..... 10/76 T; 10/169

[51] Int. Cl.[2] ..... B21J 5/12; B21K 1/64; B21K 27/00

[58] Field of Search ..... 10/11 T, 12 R, 12 T, 10/76 T, 169, 72 T; 72/421; 221/167, 265, 169

[56] References Cited

UNITED STATES PATENTS

| | | | |
|---|---|---|---|
| 252,440 | 1/1882 | Duckworth | 10/12 T |
| 912,250 | 2/1909 | Messinger | 10/76 T |
| 3,571,833 | 3/1971 | Cadwallader et al. | 10/169 X |
| 3,786,527 | 1/1974 | Morton et al. | 10/169 |

*Primary Examiner*—E. M. Combs
*Attorney, Agent, or Firm*—Lane, Aitken, Dunner & Ziems

[57] ABSTRACT

A cut-off stock feeding device for an automatic high speed cold nut former and more particularly a transfer feeding disc of intermittent rotary motion provided with indentations along the periphery thereof to receive and transfer cut-off blanks to successive discs in sequence.

2 Claims, 2 Drawing Figures

CUT-OFF STOCK FEEDING DEVICE FOR AN AUTOMATIC HIGH SPEED COLD NUT FORMER

BACKGROUND OF THE INVENTION:

Generally in the conventional cold nut former, a plurality of dies are allocated on the machine frame in a series, while in front of these dies, an equal number of punches are provided on the end face of a ram, and are set up in a face to face position. The ram is able to slide back and forth. In the above mentioned mechanism, the cut off stock for making the nut is transferred to a predetermined position in front of the die and then is pressed by a punch when the ram moves in a forward direction. On the other hand, when the ram moves in a backward direction, the blank will be transferred in regular sequence to a position in front of the next die for achieving the formation of the nut or other similar products. More precisely, the transferring device for blanks which is in general use is provided with a pair of clamping arms at the lower end of a vertical axis for clamping the blank. These clamping arms make a linear back and forth motion in a left-right direction, thus transferring the blank from a position in front of a die to a position in front of the next die for achieving successive operation.

As mentioned above, when the conventional nut former is used, a cut-off stock feeding device of a very complicated structure will in general be needed. Furthermore, with the above mentioned structure in the machine, the clamping arm of the blank feeding device can only start work when the ram with the punch means provided starts to move back, and the clamping on arm which protrudes from one end of the lower portion of the vertical shaft, makes a left to right motion of 180° with its stroke equal to one pitch of two adjacent dies, resulting in a long distance of transportation. Factors such as these above-mentioned are all hindrances to economical high-speed production of such products.

SUMMARY OF THE INVENTION

A purpose of the present invention is the improvement of the defect mentioned above, and moreover, to provide a cut-off blank feed device to a kind of nut former which is able to form nuts or other kinds of products having similar shape or outline. More particularly, the subject of this invention refers to such a kind of device in which no complicated transfer clamps are used, which has a structure that is simple and easy to assemble and disassemble. The invention is further characterized in that; the distance of the transfer is only one third or less than that of the conventional device, and the customary 180° turn of the clamping arm is unnecessary, resulting in precise work without substantial errors, all of which factors make possible high speed operation.

BRIEF DESCRIPTION OF THE DRAWINGS

The function and features, together with the principle of the motion of the cut-off blank feeding device for a nut former according to the present invention, will be described in detail with accompanying illustrations as follows.

DETAILED DESCRIPTION OF THE PREFERRED EMBODIMENTS

Figure 1:
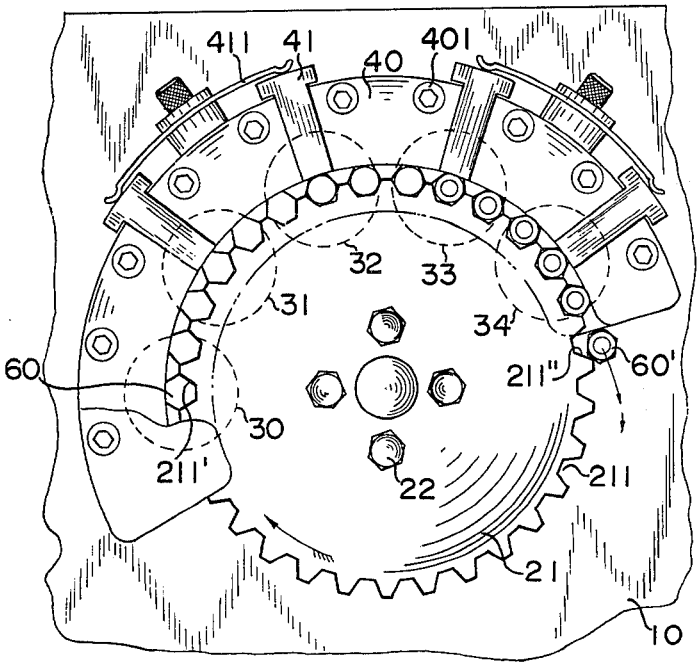
FIG. 1 depicts a partial cross section of a plan view of the blank feeding device in the present invention.
Figure 2:
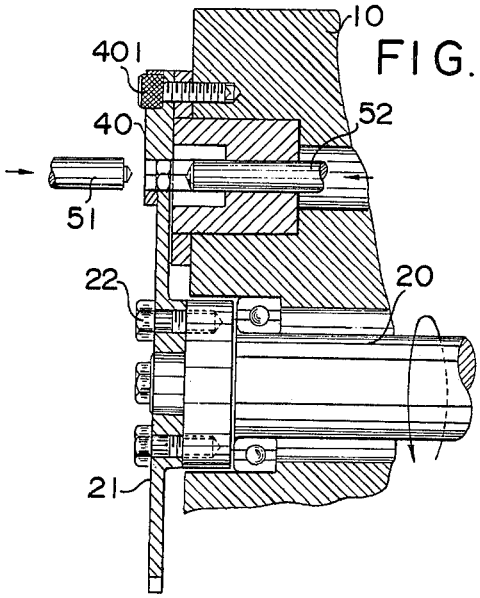
FIG. 2 illustrates a cross sectional side view of one of the dies and the rotary shaft for the blank feeding device in the present invention.

As shown in FIGS. 1 and 2, an intermittent rotary shaft 20 is provided on a machine body 10. A stock transfer feeding disc 21 is attached to the end of the shaft 20 by means of a plurality of machine screws. Dies 30, 31, 32, 33, and 34 are located radially on the circumference of the disc 21, being equidistant from each other, and having their center points aligned on the circumference of the disc 21. The dies are ordered in the sequence of operations, i.e. a cutting die, first second, and third punching stages and a final piercing stage. In this way, the periphery of the disc 21 and the locus of the center points of dies 30, 31, 32, 33, and 34 form two concentric circles of equal diameter with shaft 20 as a common center. The circular pitch between two adjacent dies measured at the circumference is sub-divided into several equal parts. (In the present embodiment according to the invention the circular pitch between the operational position of two dies is trisected.) The indentation or slot 211 on the periphery of the disc 21 is contoured so as to form one half of the exterior side of formed product so that according to the present embodiment slot 211 is contoured to form one half of the exterior side of a hexagonal nut. Slot 211 serves the purpose of feeding cut-off stock to the several dies in sequence when the disc 21 is rotated intermittentially by the intermittent rotary movement of the shaft 20.

Therefore, the individual blank, or the semiprocessed blank will be carried by virtue of the indentations 211 provided upon the periphery of the transfer feeding disc 21. In addition, an arc-shaped guide plate 40 is fixed by a plurality of machine screws 401 to the machine frame 10 and is located above the aforementioned blanks loaded on the indentations 211 respectively, with the inner surface of the guide plate 40 having the edge line congruent with the circumference of circle formed by the outer edges of the individual blanks laid in the indentations 211. Furthermore, spring loaded setting plates 41 are mounted through grooves provided in the guide plate 40, with the center line of each plate being coincident with the center line of dies 31, 32, 33, 34. Each of setting plate 41 is constantly being pressed down by a force of the leaf spring 411 for maintaining the correct position of the blanks during the forming operation.

While in operation with above mentioned arrangement, the stock which has been cut in the stage of passing the cut-off die 30 will be fed and loaded into the indentation 211 provided on the transfer feeding disc 21. The disc 21 then rotates in an intermittent way by means of the drive shaft 20 to carry the blank 60 in the indentation 211 to a pre-determined distance between two consecutive indentations. Therefore, the blank can be fed into the lower portion of the indentation 211 one after the other without having any discontinuity.

Moreover, the blank 60, which has been fed into the said indentation 211 after having been cut during passage through cut-off die 30, will be transmitted with three intermittent forward motions to a position in front of the next die 31, by means of an intermittent motion provided to the transfer disc 21 by the shaft 20. The blank 60 can be transmitted from a frontal position of the center of one die to the center of a consecutive die in sequence, such as from 31 to 32, 32 to 33, 33 to 34, in a similar fashion as described above.

When the blank 60 has been positioned in front of the die, the punch 51 fixed upon the main ram (not shown) performs the forward forming operation and starts to move back while the knock-out rod 52 provided through the die starts to move forward and push the formed stock out of the die cavity, and into the indentation on the transfer disc 21.

When the blank 60 has undergone the last punching stage of the piercing die 34, with its middle having been pierced through to form a hole, the blank will be turned out as a finished product 60'. This product 60' will fall down by its gravitational weight when the transfer disc 21 continues its motion in an intermittent way, and the indentation reaches the position 211 as shown in FIG. 1.

The primary object of the function, features, and the structure of the present invention has been stated herein before. The cut-off blank feeding device in the present invention is composed of a driving shaft rotating in an intermittent motion with a transfer feeding disc fixed upon the driving shaft so as to give an indexing movement for feeding the blanks which are located respectively in the indentations provided upon the periphery of the disc. Usually, the pitch between two adjacent indentations is smaller than the pitch between two dies for performing successive stages; therefore, the disc should make several intermittent moves to transfer a blank from one stage to the other. Also, the disc is required only to move intermittently and continuously in one direction.

Another advantage which can be obtained from the device in the present invention is the feasibility of providing a blank feeding device of simplified construction, and increased productivity. In conventional feeding devices, the clamping arm provided in the mechanism must be moved in a linear way from the front of one die to the next die. When the ram and the punch move back, then the knock-out rod of the die will eject the blank and insert the said blank into the clamping arm. On the contrary, the blank which has been processed in one stage, can be pushed out of the die by means of the knock-out rod of the same stage and then be loaded into the indentation of the blank feeding disc. Looking at the comparison made hereinbefore, the feeding device of the present invention has no need to use the conventional transfer clamping device which involves complicated mechanisms and eliminates the difficulty of assembling and disassembling the device. Moreover, the saving of time will be the great advantage as it provides the basis of high-speed operation in forming machines.

I claim:

1. In combination with an automatic, high-speed, cold nut former having a plurality of insert dies arcuately positioned such that the center of each die is located with equal circular pitch along the circumference of a circle and allocated in order of successive operations in the nut forming process and a drive shaft adapted to transmit intermittent, rotary motion, a cut-off stock feeding device comprising:

a transfer feeding disc coaxially affixed upon one end of said drive shaft, the peripheral edge of said disc in alignment with the locus of the centers of said dies, said disc sequentially transferring the cut-off stock blanks to the center of each of said plurality of dies upon intermittent rotation of said shaft;

a plurality of indentations along the peripheral edge of said disc, said indentations having the same contour as one side of the formed article to receive and accommodate the cut-off stock blanks;

means for transferring a cut-off stock blank to a die from the indentation aligned with said die;

means for returning, upon completion of a forming operation, said cut-off stock blank from said die to the same indentation from which said blank was transferred; and means cooperating with said disc for retaining said stock blank in said indentation upon return of said blank from one of said dies.

2. The combination according to claim 1 wherein said retaining means includes:

an arcuate guide plate juxtaposed to said disc such that an edge of said guide plate is congruent with the arc formed by the outer edges of stock blanks located in said indentations of said disc; and a biased setting plate cooperating with said guide plate to maintain the position of said blanks during the forming operation.

* * * * *